US007553264B2

(12) United States Patent
Carter

(10) Patent No.: US 7,553,264 B2
(45) Date of Patent: Jun. 30, 2009

(54) PUSH/PULL EXERCISE APPARATUS, DEVICE, AND METHOD

(75) Inventor: Kenneth Carter, Pomona, CA (US)

(73) Assignee: TuffStuff Fitness Equipment, Inc., Pomona, CA (US)

( * ) Notice: Subject to any disclaimer, the term of this patent is extended or adjusted under 35 U.S.C. 154(b) by 117 days.

(21) Appl. No.: 11/804,378

(22) Filed: May 18, 2007

(65) Prior Publication Data

US 2008/0287270 A1 Nov. 20, 2008

(51) Int. Cl.
*A63B 21/062* (2006.01)

(52) U.S. Cl. ..... 482/102; 482/138; 482/908

(58) Field of Classification Search ..... 482/92–94, 482/98–103, 138, 908; 254/398–399, 401–403
See application file for complete search history.

(56) References Cited

U.S. PATENT DOCUMENTS 1,436,608 A * 11/1922 Rodier ..... 254/399
4,836,535 A 6/1989 Pearson
4,953,855 A 9/1990 Shields
5,044,629 A 9/1991 Ryan et al.
5,135,453 A 8/1992 Sollenberger
5,184,992 A 2/1993 Banks
5,263,915 A * 11/1993 Habing ..... 482/99
5,328,428 A 7/1994 Huang
5,725,459 A 3/1998 Rexach
5,951,444 A * 9/1999 Webber ..... 482/99
6,338,701 B1 * 1/2002 Webber ..... 482/99
6,447,430 B1 9/2002 Webb et al.
6,527,683 B2 3/2003 Tolles
6,582,346 B1 * 6/2003 Lines et al. ..... 482/102
7,044,897 B2 5/2006 Myers et al.
7,070,546 B1 7/2006 Grasso
7,211,030 B1 * 5/2007 Cao ..... 482/99
2002/0091043 A1 * 7/2002 Rexach ..... 482/98
2002/0193213 A1 12/2002 Batca et al.
2003/0027696 A1 2/2003 Baumler et al.
2003/0060345 A1 * 3/2003 Piane, Jr. ..... 482/100
2004/0082444 A1 4/2004 Golesh
2006/0019804 A1 1/2006 Young

* cited by examiner

*Primary Examiner*—Loan H Thanh
*Assistant Examiner*—Oren Ginsberg
(74) *Attorney, Agent, or Firm*—Cislo & Thomas, LLP

(57) ABSTRACT

An apparatus, a device, and corresponding methods for exercise which involve a frame having a substantially right-angle configuration for facilitating its accommodation into a corner of a room and for optimizing its footprint in the room, a pulley system having an adjustable resistance device using a pulley ratio technique, a fixed high pull mechanism, a fixed low pull mechanism, a cross-over exercise mechanism, and a lifting bar, the lifting bar having linear bearings and handles, and the handles subtending an angle in a range of approximately 0 degrees to approximately 45 degrees.

21 Claims, 12 Drawing Sheets

PUSH/PULL EXERCISE APPARATUS, DEVICE, AND METHOD

TECHNICAL FIELD

The present invention technically relates to apparatuses, devices, and methods for exercising. More particularly, the present invention technically relates to apparatuses, devices, and methods for exercising upper body muscle groups. Even more particularly, the present invention technically relates to apparatuses, devices, and methods for providing a variety of upper body exercises.

BACKGROUND ART

Over the past several years, people have become more interested in maintaining good physical health by deliberately engaging in exercise and other physical activities. Weightlifting is but one of the many types of exercise that people choose in order to maintain fitness. Swimming, running, rowing, aerobic activity, as well as other forms of exercise are also used in order to maintain physical fitness and to provide some aerobic challenge to a person's physiological system so that they may maintain better health. The link between physical activity and physical health is well recognized.

Weightlifting is often a preferred form of physical activity, because particular muscle groups, which may have importance for specific sports or the like, can be targeted and developed. Consequently, through weightlifting, an individual can focus actively on the biceps, triceps, calves, thighs, gluteals, abdominals, etc. In so doing, the individual may not only engage in an aerobic activity, but also engage in an activity that specifically strengthens a chosen muscle or group of muscles.

A significant number of exercise machines are available which allow the individual to target particular muscles of the upper body, including the pectorals, the biceps, the triceps, the shoulders, the latissimus dorsi, and other back muscles. Combination machines also exist in the current art which allow for the individual to exercise more than one muscle group. Nevertheless, such combination machines are very limited in their scope of exercises available to any individual, especially upper body exercises. Such machines entail manual adjustments for varying the resistance (manually handling the weights).

Thus, a need is seen to exist for an exercise machine that allows for a wide variety of upper body exercises to be accomplished by the individual without the need to attach or remove parts from the machine and which provides user-friendly adjustable resistance for a plurality of upper body muscle group exercises.

DISCLOSURE OF THE INVENTION

The present invention addresses the needs seen to exist in the related art in an exercise apparatus that allows for a wide variety of upper body exercises to be accomplished by the individual without the need to attach or remove parts from the machine and which provides user-friendly adjustable resistance for a plurality of upper body muscle group exercises. The present invention promotes strength, toning, and flexibility of major muscle groups in the upper body through a combination of elements which facilitates performing a plurality of upper body muscle group exercises. The present invention involves a multifunctional trainer for ready disposition in a corner of a room, e.g., of a gymnasium, a sports club, or an athletic club.

The present invention exercise apparatus comprises a frame having a substantially right-angle configuration for facilitating its accommodation into a corner of a room and for optimizing its footprint in the room, a pulley system being mechanically coupled to the frame and having an adjustable resistance device using a pulley ratio technique in its operation, at least one weight stack being mechanically coupled to the frame and to the pulley system, and a force mechanism being mechanically coupled to the frame and to the pulley system. The present invention adjustable resistance device comprises a single pulley and a double pulley, the double pulley being detachably engageable with the single pulley, and the device using a pulley ratio technique in its operation.

The present invention method of fabricating an exercise apparatus comprises the steps of providing a frame having a substantially right-angle configuration for facilitating its accommodation into a corner of a room and for optimizing its footprint in the room, providing a pulley system being mechanically coupled to the frame and having an adjustable resistance device which uses a pulley ratio technique, providing at least one weight stack being mechanically coupled to the frame and to the pulley system, and providing a force mechanism being mechanically coupled to the frame and to the pulley system. The present invention method of fabricating an adjustable resistance device comprises the steps of providing a single pulley and providing a double pulley, the double pulley providing step comprises providing the double pulley being detachably engageable with the single pulley, and -the device using a pulley ratio technique in its operation.

The present invention method of exercising by way of an exercise apparatus comprises the steps of providing an exercise apparatus and actuating the force mechanism by an exerciser, thereby performing an exercise. The exercise apparatus providing step comprises the steps of providing a frame having a substantially right-angle configuration for facilitating its accommodation into a corner of a room and for optimizing its footprint in the room, providing a pulley system being mechanically coupled to the frame and having an adjustable resistance device which uses a pulley ratio technique, providing at least one weight stack being mechanically coupled to the frame and to the pulley system, and providing a force mechanism being mechanically coupled to the frame and to the pulley system. The present invention method of using an adjustable resistance device comprises the steps of providing a single pulley, providing a double pulley being detachably engageable with the single pulley, the device using a pulley ratio technique in its operation, and performing at least one step such as engaging the double pulley with the single pulley and disengaging the double pulley from the single pulley.

Advantages of the present invention include, but are not limited to, strengthening of the muscle groups of the torso, the chest, the back, the shoulders, the arms, and the hands. Other advantages and features of the present invention are disclosed, or are apparent, in the section entitled "Mode(s) for Carrying-Out the Invention," disclosed, infra.

BRIEF DESCRIPTION OF THE DRAWINGS

For better understanding of the present invention, reference is made to the below-referenced accompanying Drawings. Reference numbers refer to the same or equivalent parts of the present invention throughout the several figures of the Drawing.

MODE(S) FOR CARRYING OUT THE INVENTION

Figure 1:
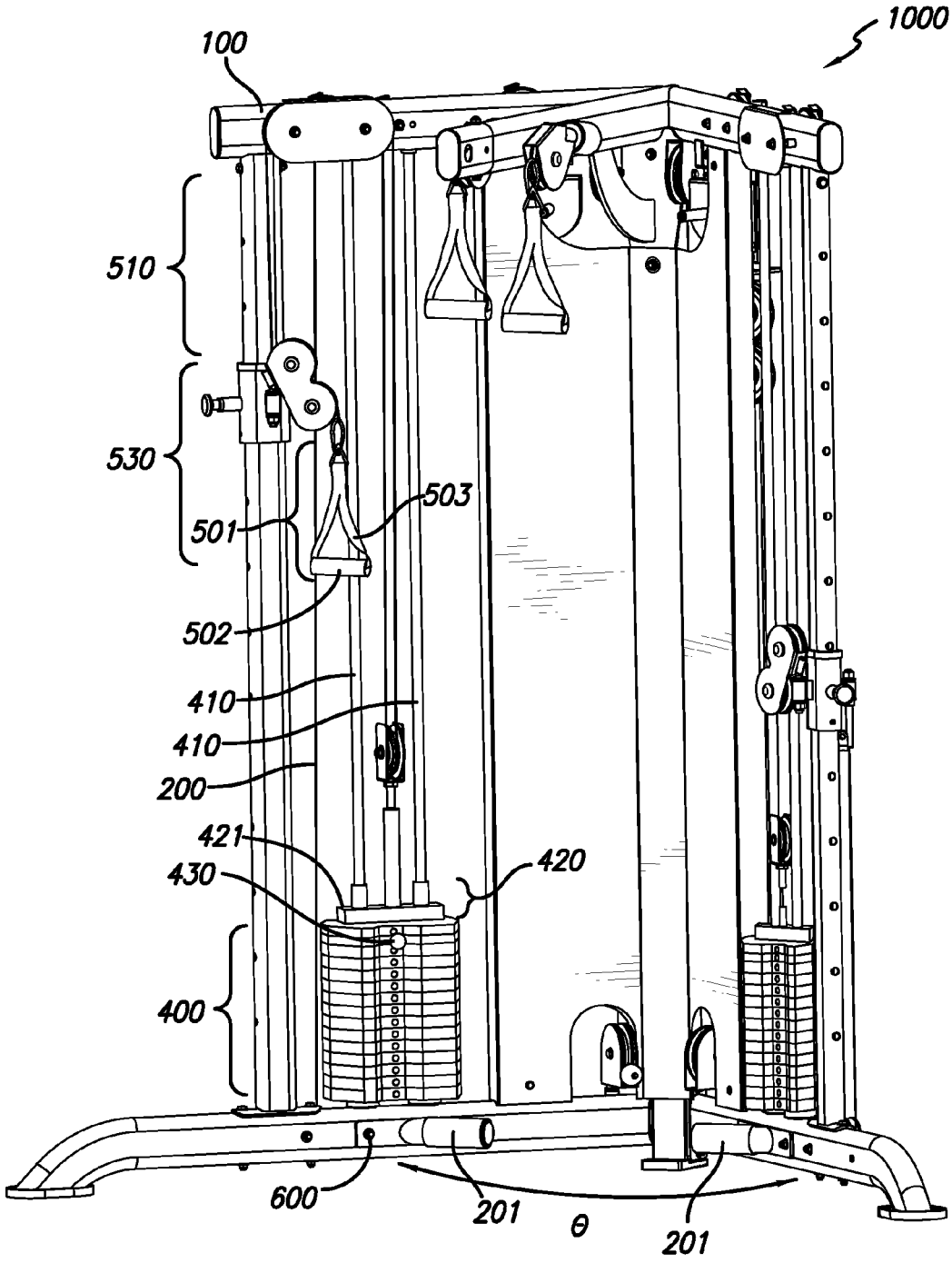
FIG. 1 is a frontal perspective view of an exercise apparatus, in accordance with the present invention.

FIG. 1 illustrates, in a frontal perspective view, an exercise apparatus 1000, in accordance with the present invention. The exercise apparatus 1000 comprises a frame 100 having a substantially right-angle ⊖ configuration for facilitating its accommodation into a corner of a room (not shown) and for optimizing its footprint in the room, a pulley system 200 being mechanically coupled to the frame 100 and having an adjustable resistance device 300 using a pulley ratio technique in its operation (see FIGS. 3 and 4), at least one weight stack 400 being mechanically coupled to the frame 100 and to the pulley system 200, and a force mechanism being mechanically coupled to the frame 100 and to the pulley system 200. The present invention adjustable resistance device 300 comprises a single pulley 310 and a double pulley 320, the double pulley 320 being detachably engageable with the single pulley 310 and the device 300 using a pulley ratio technique in its operation (see FIGS. 3 and 4). The overall dimensions are preferably as follows: approximately 84.25 inches in height, approximately 54.75 inches on a side, approximately 77.43 inches wide, and approximately 67.05 inches deep.

Still referring to FIG. 1, the force mechanism comprises at least one element such as a fixed high pull mechanism 510, a fixed low pull mechanism (not shown), a cross-over exercise mechanism 530, and a lifting bar 540 (see FIGS. 2A-2E). The lifting 540 bar (see FIGS. 2A-2E) comprises a horizontal bar 541, a pair of handles 545, and a plurality of linear bearings (not shown), wherein each handle of the pair of handles 545 subtends an angle $\alpha$, in a range of approximately 0 degrees to approximately 45 degrees and preferably approximately 45 degrees, with the horizontal bar 541. Each of the fixed high pull mechanism 510, the fixed low pull mechanism 520, and the cross-over exercise mechanism 530 further comprises a handle 501, e.g., a stirrup handle, for facilitating gripping by the exerciser. The handle 501 comprises a rubber grip 502 and rugged flexible component 503. The rugged flexible component 503 comprises at least one material such as leather, nylon, polyester, and Kevlar®. The apparatus 1000 further comprises at least one foot support 201, e.g., a pair of foot supports 201, for bracing the feet of an exerciser. Each at least one foot support 201 may further comprise an ankle strap (not shown) for providing further support to the exerciser's foot, wherein the ankle strap may comprise at least one rugged flexible material such as leather, nylon, polyester, and Kevlar®.

Still referring to FIG. 1, each at least one weight stack 400 is mechanically coupled to the frame 100 by at least one, and preferably a pair of guide rods 410, wherein the at least one guide rod 410 is mounted to the frame 100 via at least one fastener 600, and wherein the at least one fastener 600 comprises at least one element such as a locking screw, a bolt, a pin connection, a locking pin, a rivet, and the like. The at least one fastener 600 further comprises at least one element such as a washer and a nut. The at least one fastener 600 may also mechanically couple the at least one foot support 201 to the frame 100. Each at least one weight stack 400 further comprises a top plate selector bar 420 for facilitating selection of an actual weight; and a selector pin 430 being mechanically coupled to the top plate selector bar 420 and for selective insertion into a weight 401 in the weight stack 400. The selector pin 430 may be mechanically coupled to the top plate selector bar 420 by a coil spring 440 (see FIGS. 2A-2E). The top plate selector bar 420 comprises a top plate 421 and a selector bar 422 (see FIG. 7). The selector bar has a plurality of orifices (not shown), each orifice corresponding to a position of each weight 401 in the weight stack 400, being mechanically coupled to the top plate 421, and being disposed through the weight stack 400. Also, the selector pin 430 is further disposed through a weight 401 being selected for defining an actual weight for a given exercise. The top plate selector bar 420 is, in particular, mechanically coupled to the pulley system 200. The selector pin 430 comprises the following preferable dimensions: approximately ⅜ inch in diameter and approximately 3.25 inches in length.

Figure 2A:
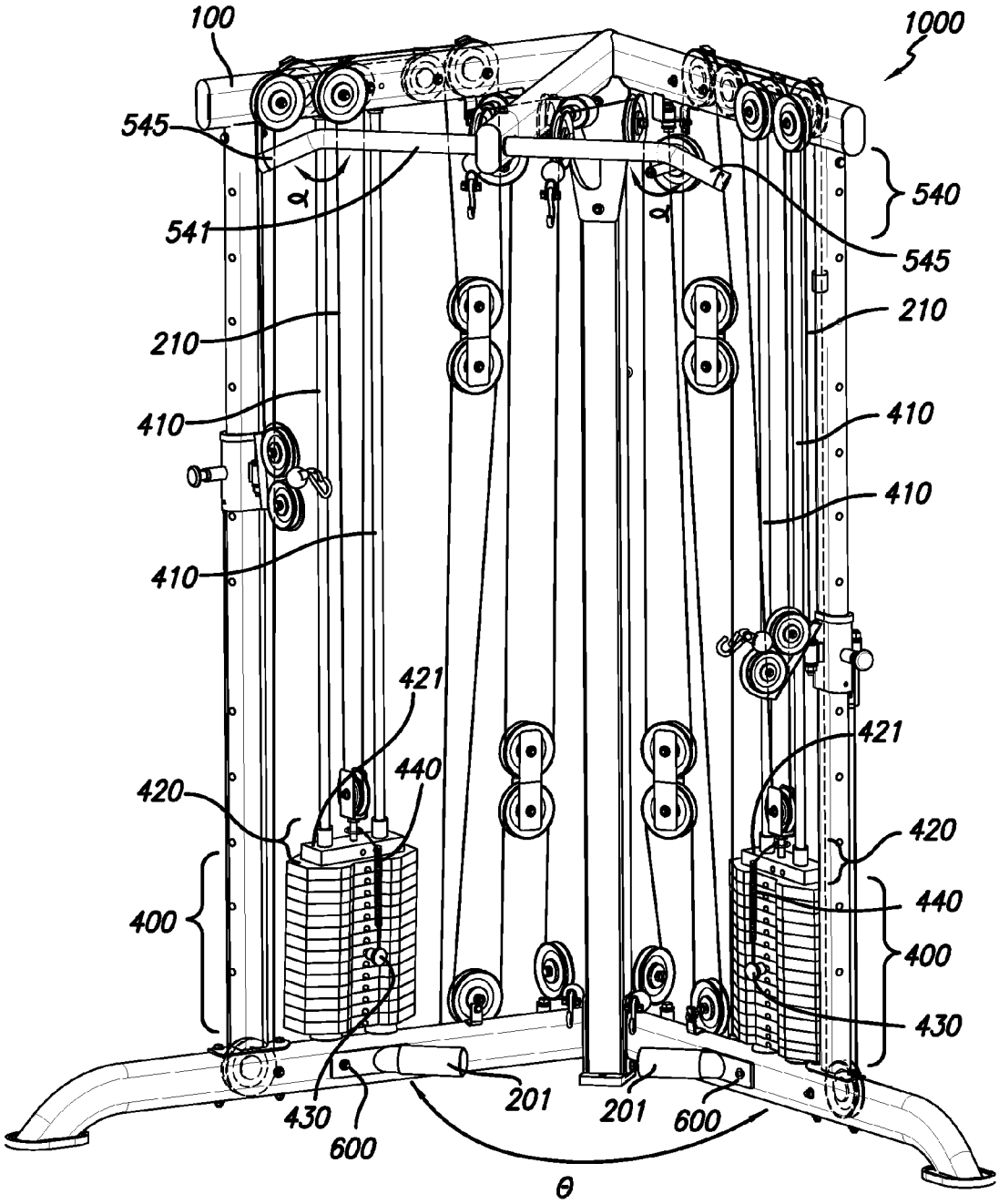
FIG. 2A is a schematic view of an exercise apparatus showing its general cable routings, in accordance with the present invention.

FIG. 2A illustrates, in a schematic view, an exercise apparatus 1000 showing its general cable routings 210, in accordance with the present invention. The cable routings 210 are shown in an isolated manner for ease of visualization. The general cable routing 210 is multifunctional and is used in connection with all of the present invention force mechanisms, i.e., the fixed high pull mechanism 510, the fixed low pull mechanism 520, the cross-over exercise mechanism 530, and the lifting bar 540.

Figure 2B:
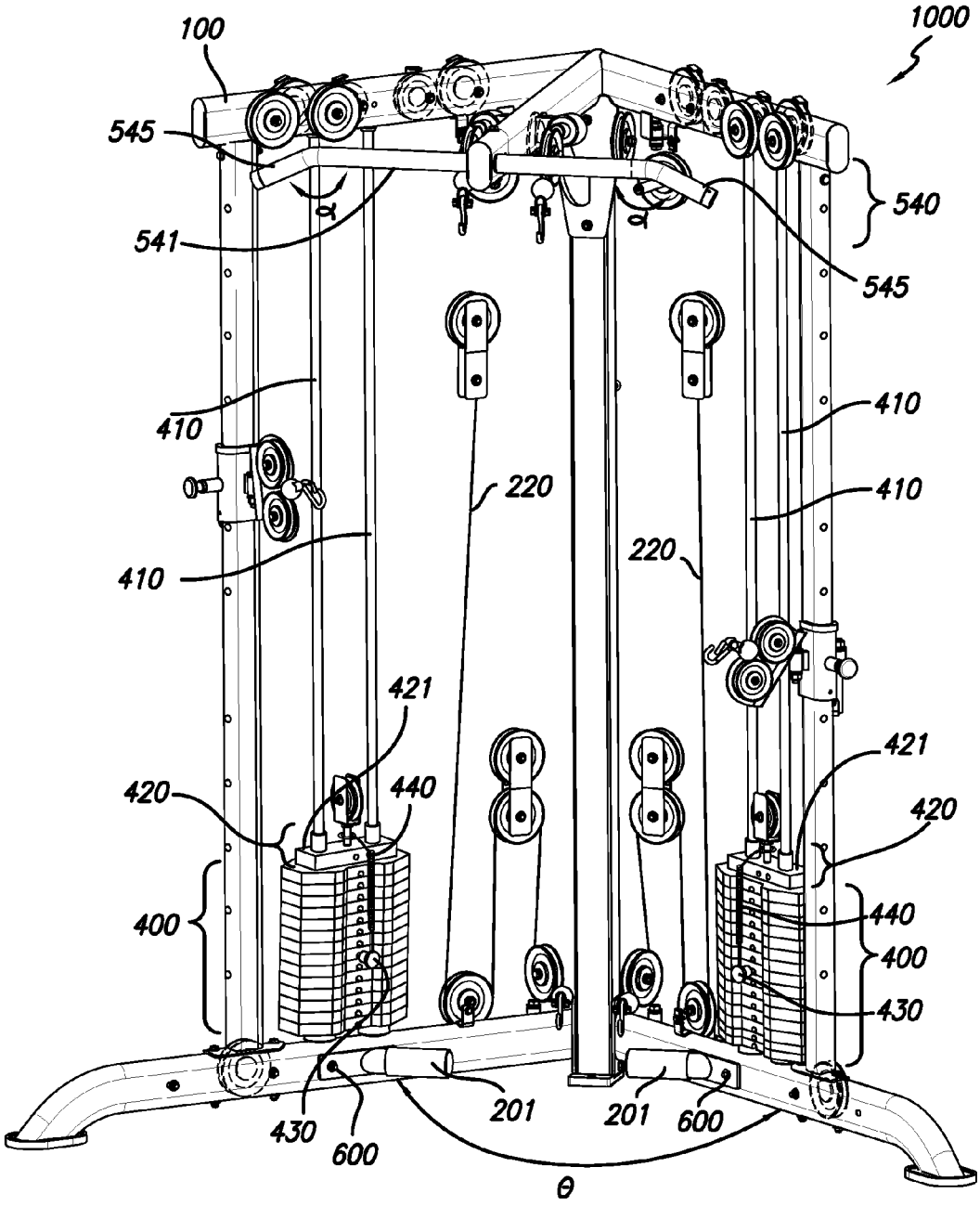
FIG. 2B is a schematic view of an exercise apparatus showing a short low row cable routing, in accordance with an alternative embodiment of the present invention.

FIG. 2B illustrates, in a schematic view, an exercise apparatus 1000 showing a short low row cable routing 220, in accordance with an alternative embodiment of the present invention. The cable routing 220 is shown in an isolated manner for ease of visualization. The short low row cable routing 220 is also used in connection with the fixed low pull mechanism 520 (see FIG. 1).

Figure 2C:
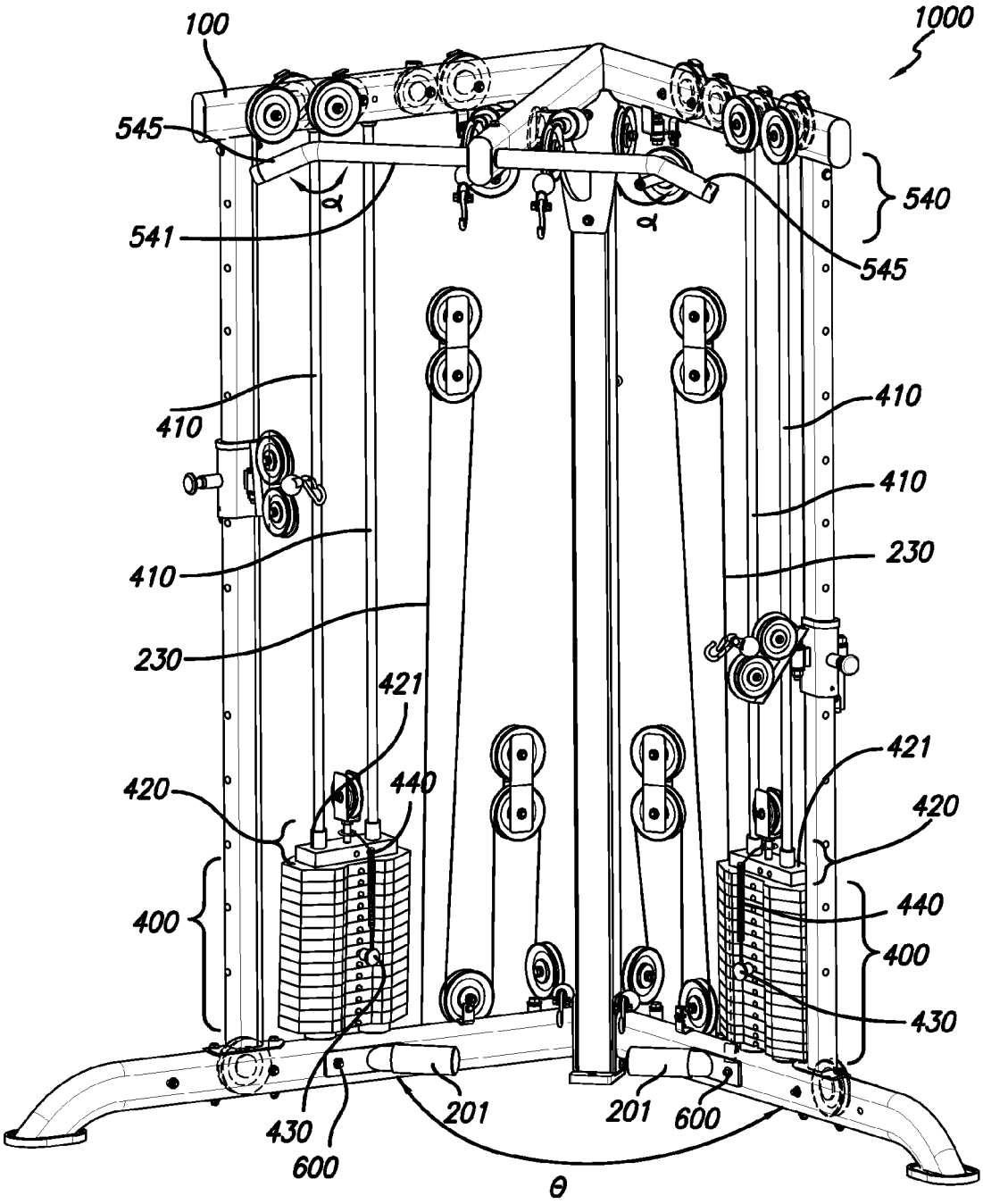
FIG. 2C is a schematic view of an exercise apparatus showing a long low row cable routing, in accordance with an alternative embodiment of the present invention.

FIG. 2C illustrates, in a schematic view, an exercise apparatus 1000 showing a long low row cable routing 230, in accordance with an alternative embodiment of the present invention. The cable routing 230 is shown in an isolated manner for ease of visualization. The long low row cable routing 230 is also used in connection with the fixed low pull mechanism 520.

Figure 2D:
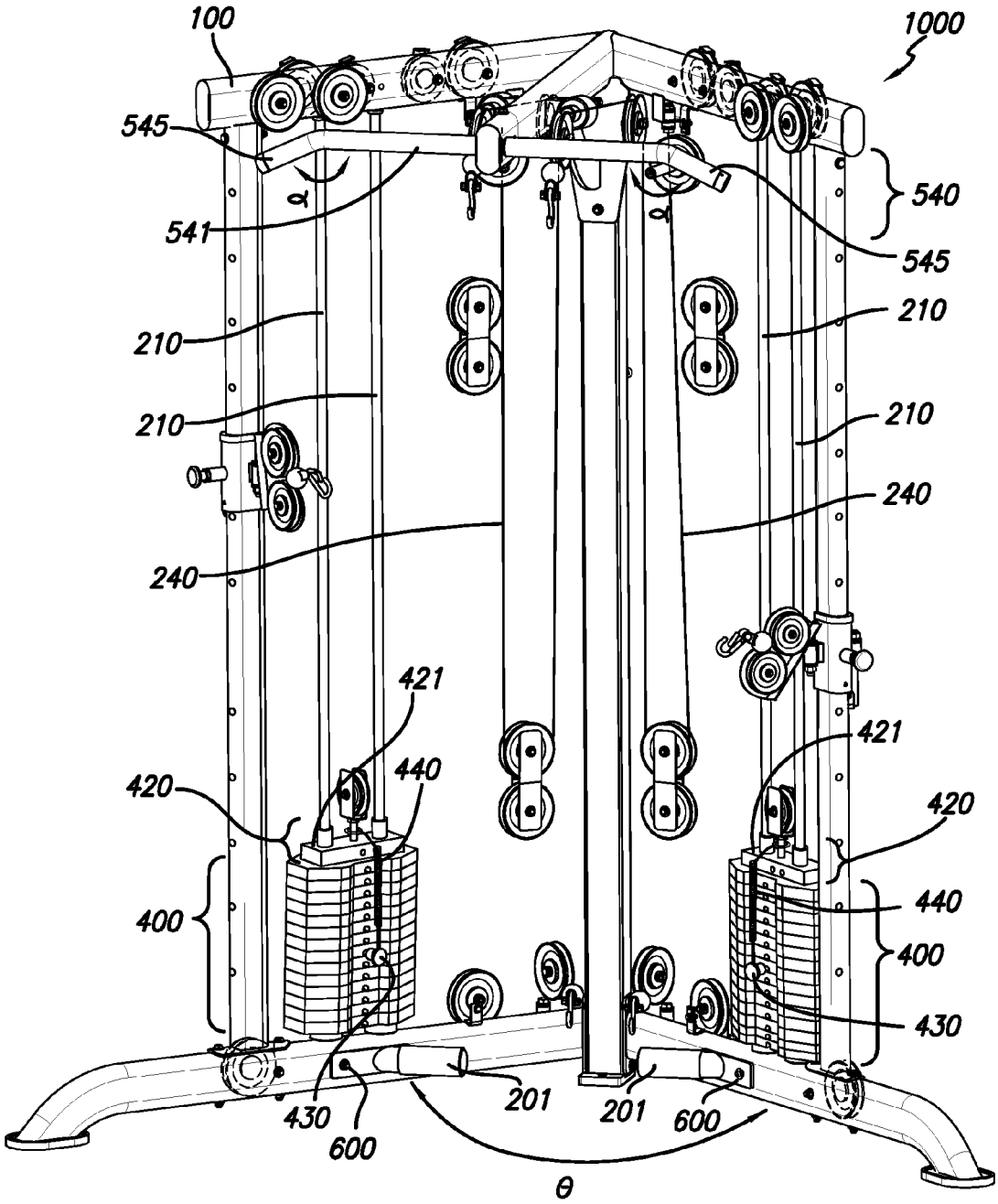
FIG. 2D is a schematic view of an exercise apparatus showing a lateral cable routing, in accordance with an alternative embodiment of the present invention.

FIG. 2D illustrates, in a schematic view, an exercise apparatus 1000 showing a lateral cable routing 240, in accordance with an alternative embodiment of the present invention. The cable routing 240 is shown in an isolated manner for ease of visualization. The lateral cable routing 240 is used in connection with the fixed high pull mechanism 510 and the lifting bar 540.

Figure 2E:
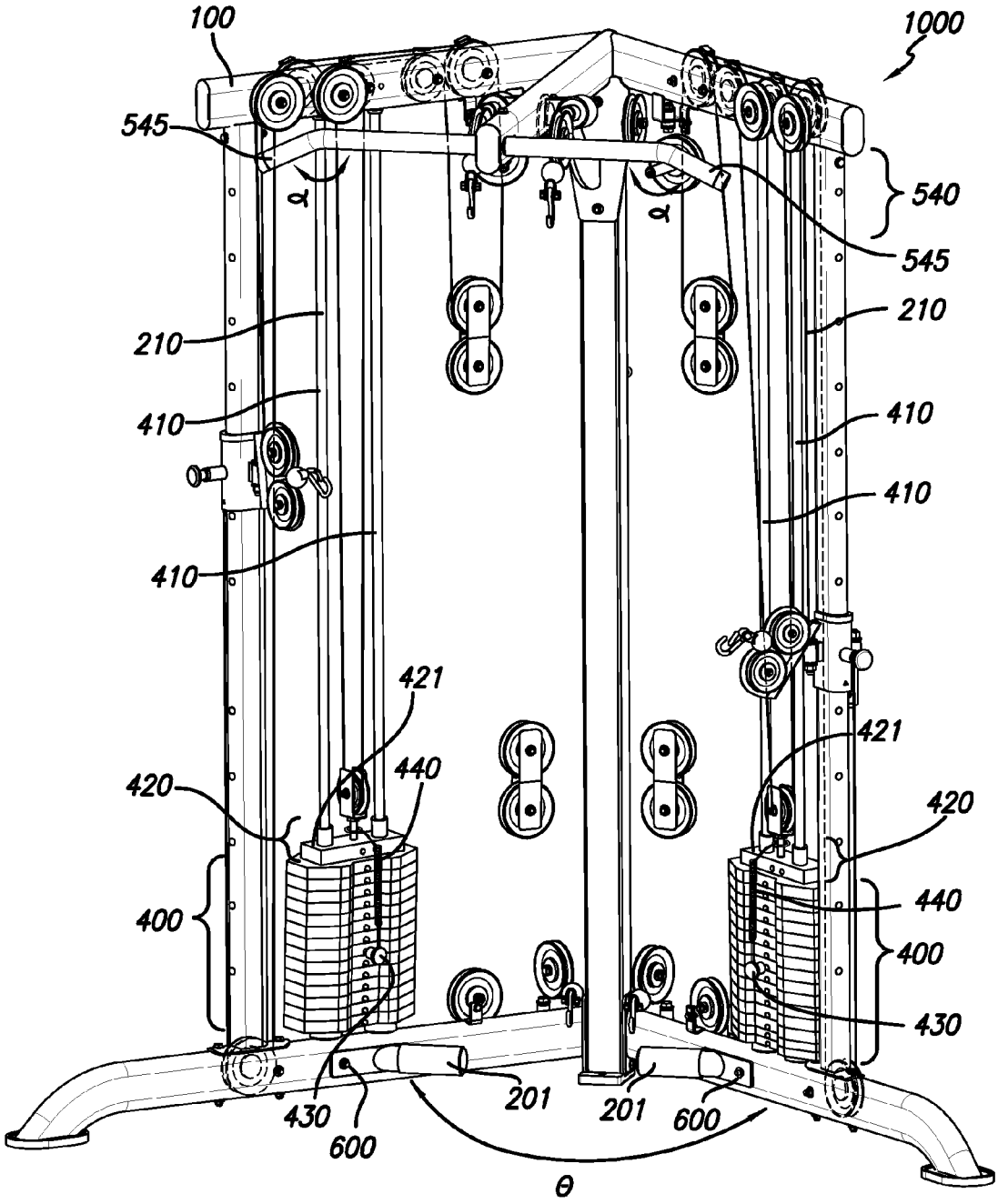
FIG. 2E is a schematic view of an exercise apparatus showing a high-low cable routing, in accordance with an alternative embodiment of the present invention.

FIG. 2E illustrates, in a schematic view, an exercise apparatus 1000 having a high-low cable routing 250, in accordance with an alternative embodiment of the present invention. The cable routing 250 is shown in an isolated manner for ease of visualization. The high-low cable routing 250 is used in connection with the cross-over exercise mechanism 530.

Figure 3:
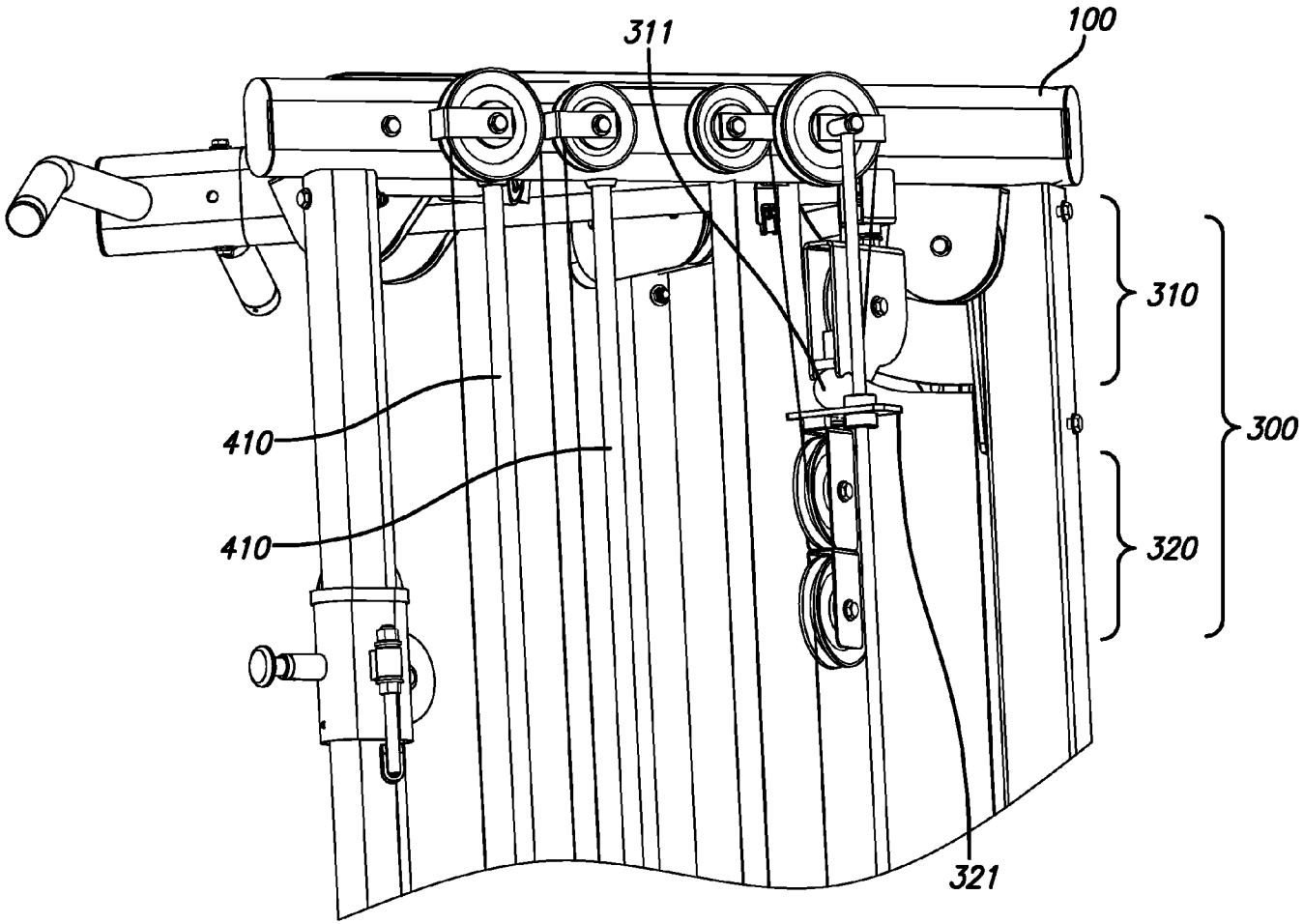
FIG. 3 is a rear side view of a top portion of the exercise, apparatus of FIG. 1, showing an adjustable resistance device at an upper limit of its travel, in accordance with the present invention.

FIG. 3 illustrates, in a rear side view, a top portion of the exercise apparatus 1000 of FIG. 1, showing an adjustable resistance device 300 at an upper limit of its travel, in accordance with the present invention. The present invention adjustable resistance device 300 comprises a single pulley 310 and a double pulley 320, the double pulley 320 being detachably engageable with the single pulley 310, and the device 300 using a pulley ratio technique in its operation. In the adjustable resistance device 300, the double pulley 320 comprises a bracket 321 having a slot 322 (see FIG. 7). The single pulley 310 is rotatable on an axis A parallel to a chord line C of the single pulley 310. The single pulley 310 comprises a coupling member 311 being insertable into the slot 322 upon rotation of the single pulley 310 on the axis A.

Figure 4:
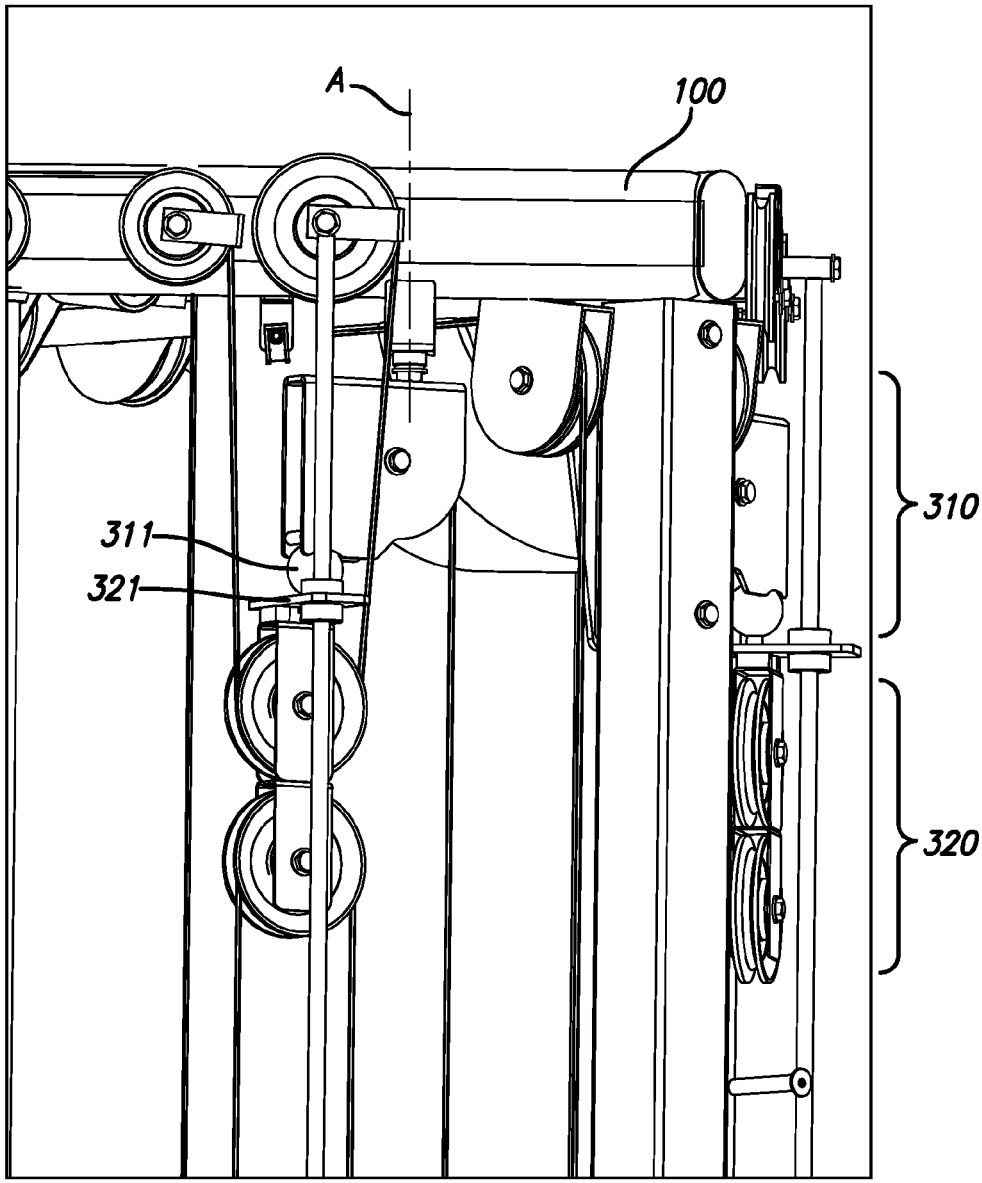
FIG. 4 is a close-in rear side view of a top portion of the exercise apparatus of FIG. 2, showing the adjustable resistance device at the upper limit of its travel, in accordance with the present invention.

FIG. 4 illustrates, in a close-in rear side view, a top portion of the exercise apparatus 1000 of FIG. 2, showing the adjustable resistance device 300 at an upper limit of its travel, in accordance with the present invention.

Figure 5:
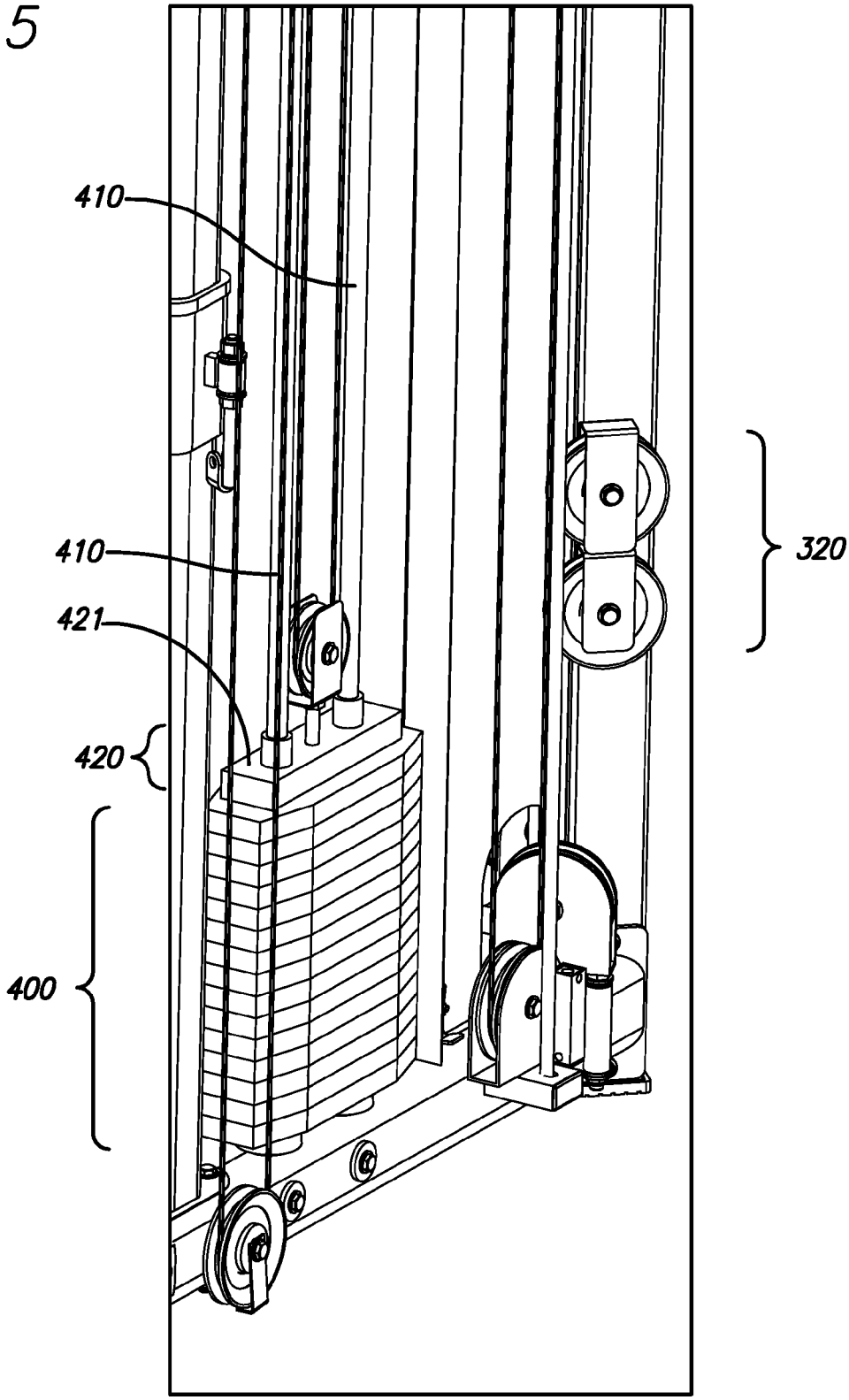
FIG. 5 is a rear side view of a bottom portion of the exercise apparatus of FIG. 1, showing the adjustable resistance device at the lower limit of its travel, in accordance with the present invention.

FIG. 5 illustrates, in a rear side view, a bottom portion of the exercise apparatus 1000 of FIG. 1, showing the adjustable resistance device 300 at the lower limit of its travel, in accordance with the present invention.

Figure 6:
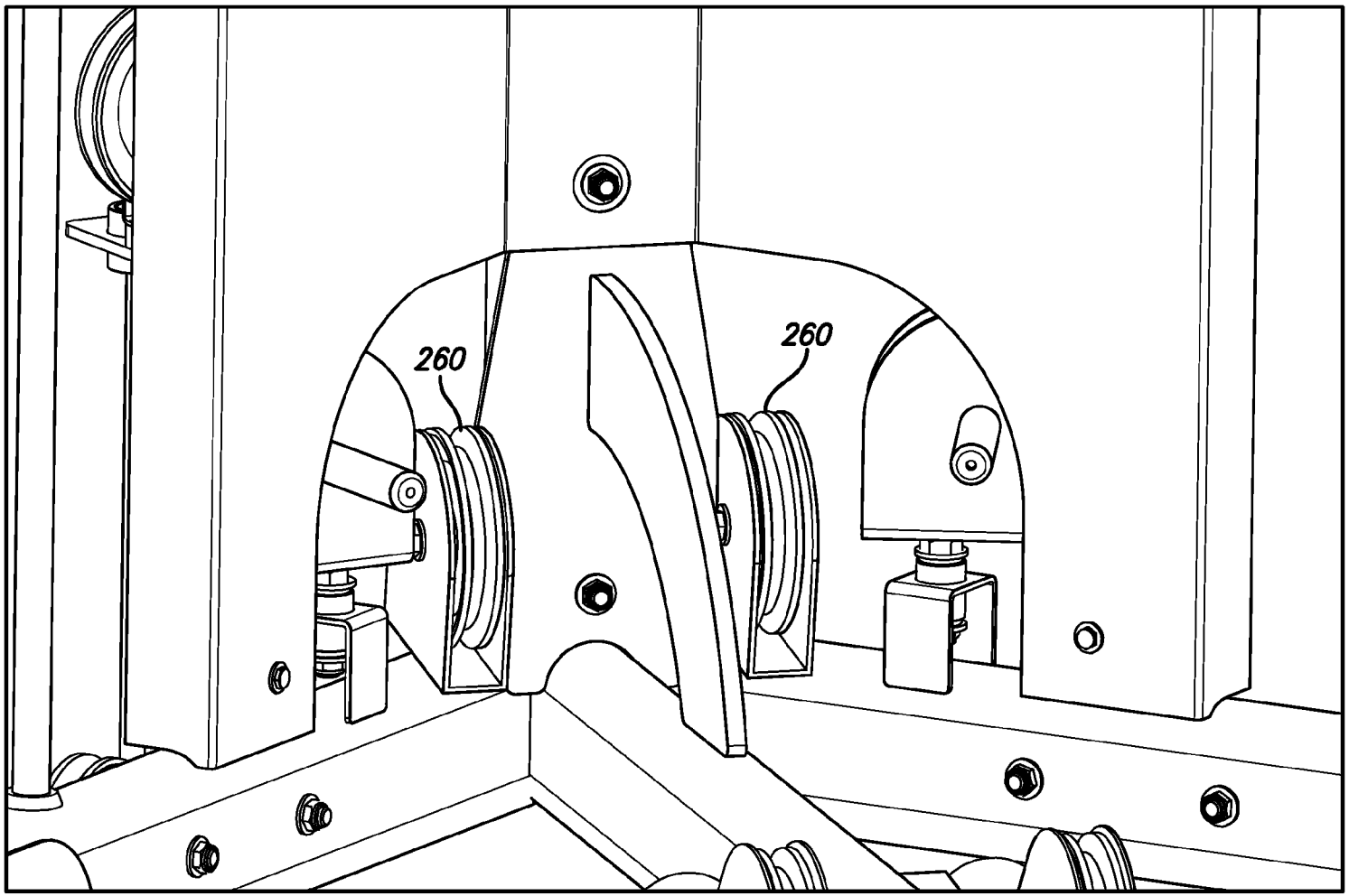
FIG. 6 is a frontal perspective view of a bottom portion of the exercise apparatus of FIG. 1, showing a pair of lower pulleys in relation to the adjustable resistance device, in accordance with the present invention.

FIG. 6 illustrates, in a frontal perspective view, the exercise apparatus 1000 of FIG. 1, showing a pair of lower pulleys 260 in relation to the adjustable resistance device 300, in accordance with the present invention.

Figure 7:
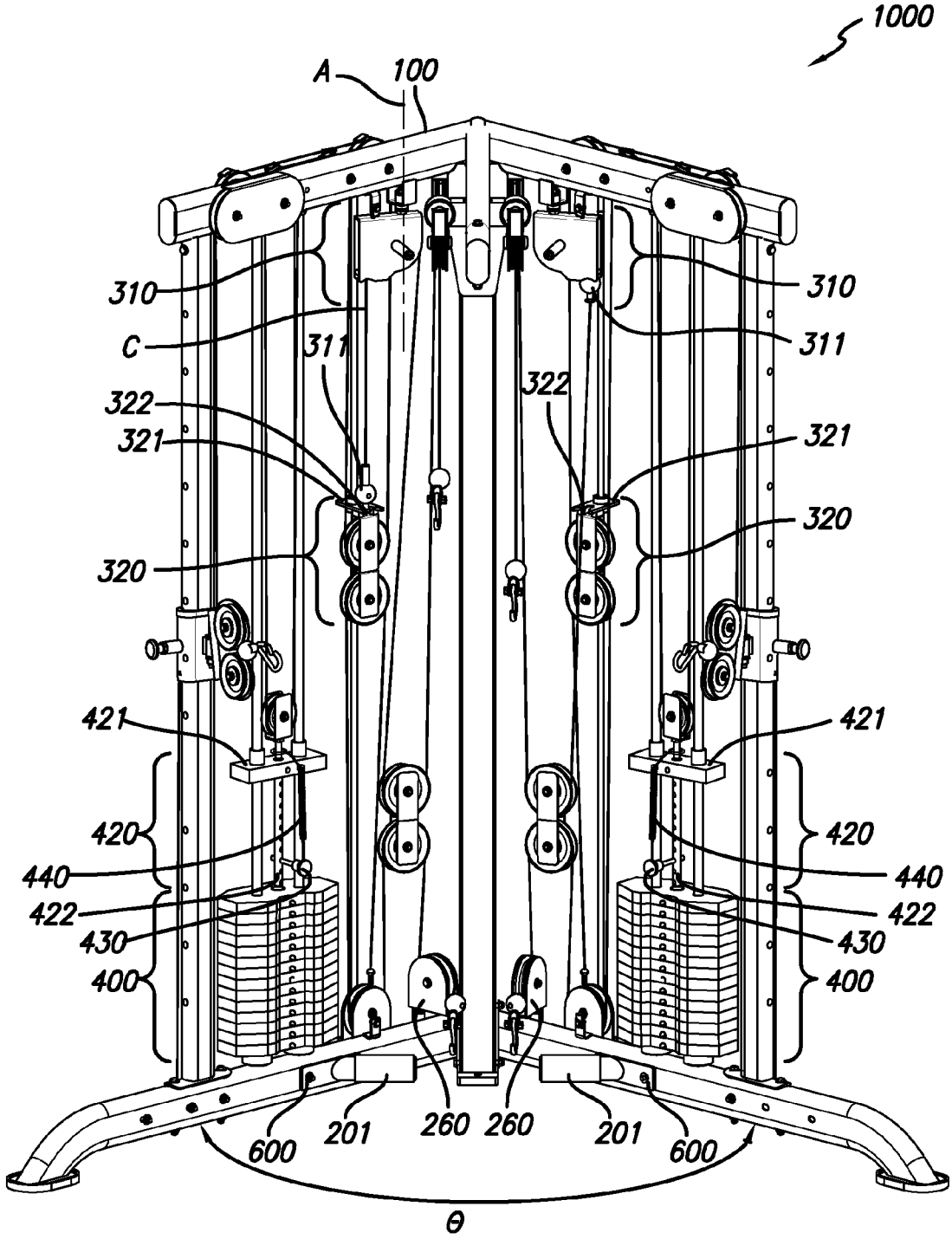
FIG. 7 is a frontal perspective view of the exercise apparatus of FIG. 1, showing a pair of lower pulleys in relation to the remaining pulley system, wherein the travel of the cable is shorter when the adjustable resistance device is engaged, i.e., more effective resistant weight is provided, and wherein the travel of the cable is longer when the adjustable resistance device is disengaged, i.e., less effective resistant weight is provided, in accordance with the present invention.

FIG. 7 illustrates, in a frontal perspective view, the exercise apparatus 1000 of FIG. 1, showing a pair of lower pulleys in relation to the remaining pulley system 200, wherein the travel of the cable is shorter when the adjustable resistance device 300 is engaged, i.e., more effective resistant weight is provided, and wherein the travel of the cable is longer when the adjustable resistance device 300 is disengaged, i.e., less effective resistant weight is provided, in accordance with the present invention. Specifically, the adjustable resistance device 300 applies tension to a single cable when the double pulley. 320 is engaged with the single pulley 310, whereby a weight ratio of approximately 100% of an actual weight is maintained; and the adjustable resistance device 300 applies tension to a pair of cables when the double pulley 320 is disengaged from the single pulley 310, whereby a weight ratio of approximately 50% of the actual weight is maintained.

Figure 8:
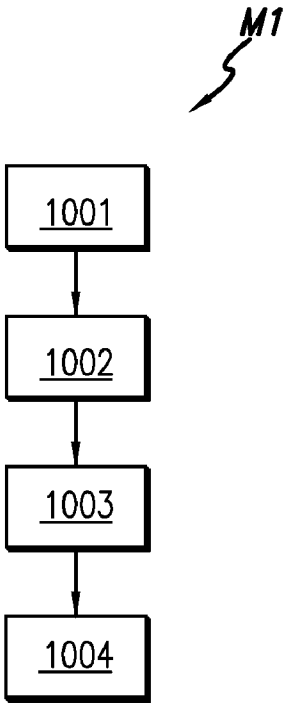
FIG. 8 is a flowchart of a method of fabricating an exercise apparatus, in accordance with the present invention.

FIG. 8 illustrates, in a flowchart, a method Ml of fabricating an exercise apparatus 1000, in accordance with the present invention. The method M1 of fabricating an exercise apparatus 1000 comprises the steps of providing a frame 100 having a substantially right-angle theta configuration for facilitating its accommodation into a corner of a room and for optimizing its footprint in the room, as indicated by block 1001, providing a pulley system 200 being mechanically coupled to the frame 100 and having an adjustable resistance device 300 which uses a pulley ratio technique, as indicated by block 1002, providing at least one weight stack 400 being mechanically coupled to the frame 100 and to the pulley system 200, as indicated by block 1003, and providing a force mechanism being mechanically coupled to the frame 100 and to the pulley system 200, as indicated by block 1004.

Still referring to FIG. 8, the pulley system 200 providing step, as indicated by block 1002, comprises providing the adjustable resistance device 300. The present invention method of fabricating an adjustable resistance device 300 comprises the steps of providing a single pulley 310 and providing a double pulley 320, the double pulley 320 providing step comprising providing the double pulley 320 being detachably engageable with the single pulley 310, and the device 300 using a pulley ratio technique in its operation.

Figure 9:
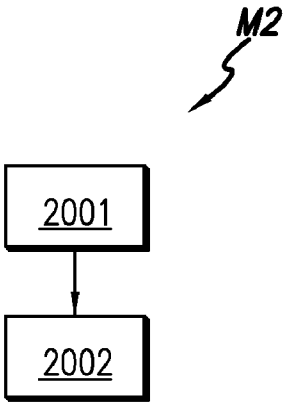
FIG. 9 is a flowchart of a method of exercising by way of an exercise apparatus, in accordance with the present invention.

FIG. 9 illustrates, in a flowchart, a method M2 of exercising by way of an exercise apparatus 1000, in accordance with the present invention. The present invention method M2 of exercising by way of an exercise apparatus 1000 comprises the steps of providing an exercise apparatus 1000, as indicated by block 2001, and actuating a force mechanism 500, as indicated by block 2002, by an exerciser (not shown), thereby performing an exercise. The exercise apparatus 1000 providing step, as indicated by block 2001, comprises the steps of providing a frame 100 having a substantially right-angle theta configuration for facilitating its accommodation into a corner of a room and for optimizing its footprint in the room, providing a pulley system 200 being mechanically coupled to the frame 100 and having an adjustable resistance device 300 which uses a pulley ratio technique, providing at least one weight stack 400 being mechanically coupled to the frame 100 and to the pulley system 200, and providing a force mechanism being mechanically coupled to the frame 100 and to the pulley system 200.

Figure 10:
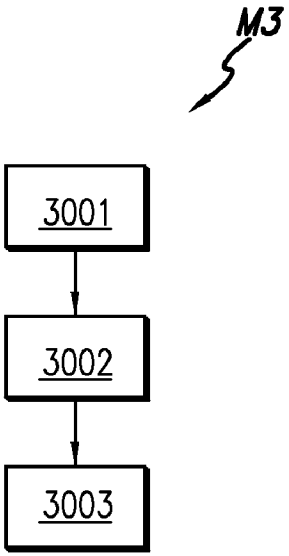
FIG. 10 is a flowchart of a method of using an adjustable resistance device, in accordance with the present invention.

FIG. 10 illustrates, in a flowchart, a method M3 of using an adjustable resistance device 300, in accordance with the present invention. The present invention method M3 of using an adjustable resistance device 300 comprises the steps of providing a single pulley 310, as indicated by block 3001, providing a double pulley 320 being detachably engageable with the single pulley 310, the device 300 using a pulley ratio technique in its operation, as indicated by block 3002, and performing at least one step such as engaging the double pulley 320 with the single pulley 310 and disengaging the double pulley 320 from the single pulley 310, as indicated by block 3003.

Information, as herein shown and described in detail, is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more." All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a system, an apparatus, a device, or a method to address each and every problem sought to be resolved by the present invention, for such subject matter to be encompassed by the present claims. Furthermore, no element, component, or method step in the present disclosure is intended to be dedicated to the public regardless of whether the element, component, or method step is explicitly recited in the claims. However, that various changes and modifications in form, configuration, method steps, and material detail may be made, without departing from the spirit and scope of the invention(s), as set forth in the appended claims, should be readily apparent to those of ordinary skill in the art and are also encompassed by the claims. No claim herein is to be construed under the provisions of 35 U.S.C. § 112, sixth paragraph, unless the element is expressly recited using the phrase "means for."

INDUSTRIAL APPLICABILITY

The present invention industrially applies to apparatuses, devices, and methods for exercising. More particularly, the present invention industrially applies to apparatuses, devices, and methods for exercising upper body muscle groups. Even more particularly, the present invention industrially applies to apparatuses, devices, and methods for providing a variety of upper body exercises.

What is claimed:

1. A multifunctional exercise apparatus, the apparatus comprising:

(a) a frame having a substantially right-angle configuration for facilitating its accommodation into a corner of a room and for optimizing its footprint in the room;

(b) a pulley system being mechanically coupled to the frame and having an adjustable resistance device using a pulley ratio technique in its operation;

(c) at least one weight stack being mechanically coupled to the frame and to the pulley system; and (d) a force mechanism being mechanically coupled to the frame and to the pulley system; wherein the adjustable resistance device comprises: a single pulley; and a double pulley, the double pulley being detachably engageable with the single pulley; wherein the double pulley comprises a bracket having a slot; wherein the single pulley is rotatable on an axis parallel to a chord line of the single pulley, and wherein the single pulley comprises a coupling member being inserted into the slot upon rotation of the single pulley on the axis.

2. An apparatus, as recited in claim 1, wherein the force mechanism comprises at least one element selected from a group consisting essentially of:

(a) a fixed high pull mechanism;

(b) a fixed low pull mechanism;

(c) a cross-over exercise mechanism; and (d) a lifting bar.

3. An apparatus, as recited in claim 2, wherein the lifting bar comprises:

a horizontal bar having two ends;

a pair of handles being coupled to the two ends; and a plurality of linear bearings being in mechanical relation to the horizontal bar.

4. An apparatus, as recited in claim 3, wherein each handle of the pair of handles subtends an angle in a range of approximately 0 degrees to approximately 45 degrees with the horizontal bar.

5. An apparatus, as recited in claim 1, wherein the force mechanism comprises a stirrup handle for facilitating gripping by an exerciser.

6. An apparatus, as recited in claim 1, wherein the adjustable resistance device applies tension to a single cable when the double pulley is engaged with the single pulley, whereby a weight ratio of approximately 100% of an actual weight is maintained, and wherein the adjustable resistance device applies tension to a pair of cables when the double pulley is disengaged from the single pulley, whereby a weight ratio of approximately 50% of the actual weight is maintained.

7. An apparatus, as recited in claim 1, wherein the force mechanism comprises at least one element selected from a group consisting essentially of:

(a) a fixed high pull mechanism;

(b) a fixed low pull mechanism;

(c) a cross-over exercise mechanism; and (d) a lifting bar, wherein the lifting bar comprises:

a horizontal bar having two ends;

a pair of handles being coupled to the two ends; and a plurality of linear bearings being in mechanical relation to the horizontal bar, wherein each handle of the pair of handles subtends an angle in a range of approximately 0 degrees to approximately 45 degrees with the horizontal bar, wherein the force mechanism comprises a stirrup handle for facilitating gripping by an exerciser, wherein the adjustable resistance device applies tension to a single cable when the double pulley is engaged with the single pulley, whereby a weight ratio of approximately 100% of an actual weight is maintained, and wherein the adjustable resistance device applies tension to a pair of cables when the double pulley is disengaged from the single pulley, whereby a weight ratio of approximately 50% of the actual weight is maintained.

8. A method of fabricating a multifunctional exercise apparatus, the method comprising the steps of:

(a) providing a frame having a substantially right-angle configuration for facilitating its accommodation into a corner of a room and for optimizing its footprint in the room;

(b) providing a pulley system being mechanically coupled to the frame and having an adjustable resistance device which uses a pulley ratio technique;

(c) providing at least one weight stack being mechanically coupled to the frame and to the pulley system; and (d) providing a force mechanism being mechanically coupled to the frame and to the pulley system; wherein the pulley providing step comprises providing the adjustable resistance device, and wherein the adjustable resistance device providing step comprises: providing a single pulley; and providing a double pulley, the double pulley providing step comprises providing the double pulley being detachably engageable with the single pulley; wherein the double pulley providing step comprises providing a bracket having a slot; the single pulley providing step comprising providing the single pulley being rotatable on an axis parallel to a chord line of the single pulley, and wherein the single pulley providing step comprises providing the single pulley with a coupling member being inserted into the slot upon rotation of the single pulley on the axis.

9. A method, as recited in claim 8, wherein the force mechanism providing step comprises providing at least one element selected from a group consisting essentially of:

(a) a fixed high pull mechanism;

(b) a fixed low pull mechanism;

(c) a cross-over exercise mechanism; and (d) a lifting bar.

10. A method, as recited in claim 9, wherein the lifting bar providing step comprises:

providing a horizontal bar having two ends;

providing a pair of handles being coupled to the two ends; and providing a plurality of linear bearings being in mechanical relation to the horizontal bar.

11. A method, as recited in claim 10, wherein the pair of handles providing step comprises subtending each handle of the pair of handles at an angle in a range of approximately 0 degrees to approximately 45 degrees with the horizontal bar.

12. A method, as recited in claim 8, wherein the force mechanism providing step comprises providing a stirrup handle for facilitating gripping by an exerciser.

13. A method, as recited in claim 8, wherein the adjustable resistance device providing step comprises providing the adjustable resistance device in a manner capable of applying tension to a single cable when the double pulley is engaged with the single pulley, thereby maintaining a weight ratio of approximately 100% of an actual weight, and wherein the adjustable resistance device providing step comprises providing the adjustable resistance device in a manner capable of applying tension to a pair of cables when the double pulley is disengaged from the single pulley, thereby maintaining a weight ratio of approximately 50% of an actual weight.

14. A method, as recited in claim 8, wherein the force mechanism providing step comprises providing at least one element selected from a group consisting essentially of:

(a) a fixed high pull mechanism;

(b) a fixed low pull mechanism;

(c) a cross-over exercise mechanism; and (d) a lifting bar, wherein the lifting bar providing step comprises:

providing a horizontal bar having two ends;

providing a pair of handles being coupled to the two ends; and providing a plurality of linear bearings being in mechanical relation to the horizontal bar, wherein the pair of handles providing step comprises subtending each handle of the pair of handles at an angle in a range of approximately 0 degrees to approximately 45 degrees with the horizontal bar, wherein the force mechanism providing step comprises providing a stirrup handle for facilitating gripping by an exerciser, wherein pulley providing step comprises providing the adjustable resistance device, and wherein the adjustable resistance device providing step comprises providing the adjustable resistance device in a manner capable of applying tension to a single cable when the double pulley is engaged with the single pulley, thereby maintaining a weight ratio of approximately 100% of an actual weight, and wherein the adjustable resistance device providing step comprises providing the adjustable resistance device in a manner capable of applying tension to a pair of cables when the double pulley is disengaged from the single pulley, thereby maintaining a weight ratio of approximately 50% of the actual weight.

15. A method of exercising by way of a multifunctional exercise apparatus, the method comprising the steps of:

providing a multifunctional exercise apparatus, the multifunctional exercise apparatus providing step comprising the steps of:

(a) providing a frame having a substantially right-angle configuration for facilitating its accommodation into a corner of a room and for optimizing its footprint in the room;

(b) providing a pulley system being mechanically coupled to the frame and having an adjustable resistance device which uses a pulley ratio technique;

(c) providing at least one weight stack being mechanically coupled to the frame and to the pulley system; and (d) providing a force mechanism being mechanically coupled to the frame and to the pulley system; and actuating the force mechanism by an exerciser, thereby performing an exercise; wherein the pulley providing step comprises providing the adjustable resistance device, and wherein the adjustable resistance device providing step comprises: providing a single pulley; and providing a double pulley, the double pulley providing step comprises providing the double pulley being detachably engageable with the single pulley; wherein the double pulley providing step comprises providing a bracket having a slot; wherein the single pulley providing step comprises providing the single pulley being rotatable on an axis parallel to a chord line of the single pulley, and wherein the single pulley providing step comprises providing the single pulley with a coupling member being inserted into the slot upon rotation of the single pulley on the axis.

16. A method, as recited in claim 15, wherein the force mechanism providing step comprises providing at least one element selected from a group consisting essentially of:

(a) a fixed high pull mechanism;

(b) a fixed low pull mechanism;

(c) a cross-over exercise mechanism; and (d) a lifting bar.

17. A method, as recited in claim 16, wherein the lifting bar providing step comprises:

providing a horizontal bar having two ends;

providing a pair of handles being coupled to the two ends; and providing a plurality of linear bearings being in mechanical relation to the horizontal bar.

18. A method, as recited in claim 17, wherein the pair of handles providing step comprises subtending each handle of the pair of handles at an angle in a range of approximately 0 degrees to approximately 45 degrees with the horizontal bar.

19. A method, as recited in claim 15, wherein the force mechanism providing step comprises providing a stirrup handle for facilitating gripping by an exerciser.

20. A method, as recited in claim 15, wherein the adjustable resistance device providing step comprises providing the adjustable resistance device in a manner capable of applying tension to a single cable when the double pulley is engaged with the single pulley, thereby maintaining a weight ratio of approximately 100% of an actual weight, and wherein the adjustable resistance device providing step comprises providing the adjustable resistance device in a manner capable of applying tension to a pair of cables when the double pulley is disengaged from the single pulley, thereby maintaining a weight ratio of approximately 50% of the actual weight.

21. A method, as recited in claim 15, wherein the force mechanism providing step comprises providing at least one element selected from a group consisting essentially of:

(a) a fixed high pull mechanism;

(b) a fixed low pull mechanism;

(c) a cross-over exercise mechanism; and (d) a lifting bar, wherein the lifting bar providing step comprises:

providing a horizontal bar having two ends;

providing a pair of handles being coupled to the two ends; and providing a plurality of linear bearings being in mechanical relation to the horizontal bar, wherein the pair of handles providing step comprises subtending each handle of the pair of handles at an angle in a range of approximately 0 degrees to approximately 45 degrees with the horizontal bar, wherein the force mechanism providing step comprises providing a stirrup handle for facilitating gripping by an exerciser, wherein the adjustable resistance device providing step comprises providing the adjustable resistance device in a manner capable of applying tension to a single cable when the double pulley is engaged with the single pulley, thereby maintaining a weight ratio of approximately 100% of an actual weight, and wherein the adjustable resistance device providing step comprises providing the adjustable resistance device in a manner capable of applying tension to a pair of cables when the double pulley is disengaged from the single pulley, thereby maintaining a weight ratio of approximately 50% of the actual weight.

* * * * *